US008231067B1

(12) United States Patent
Robinson

(10) Patent No.: US 8,231,067 B1
(45) Date of Patent: Jul. 31, 2012

(54) STRAW

(76) Inventor: Ted R. Robinson, Gilbert, AZ (US)

( * ) Notice: Subject to any disclaimer, the term of this patent is extended or adjusted under 35 U.S.C. 154(b) by 967 days.

(21) Appl. No.: 12/247,116

(22) Filed: Oct. 7, 2008

Related U.S. Application Data

(62) Division of application No. 10/993,820, filed on Nov. 19, 2004, now abandoned.

(51) Int. Cl.
*A47G 21/18* (2006.01)

(52) U.S. Cl. ..... 239/33; 604/77; 604/84; 426/85

(58) Field of Classification Search ..... 239/24, 239/33; 604/77, 83, 84; 426/85; 424/464, 424/468, 473
See application file for complete search history.

(56) References Cited

U.S. PATENT DOCUMENTS

| | | | | | |
|---|---|---|---|---|---|
| 2,815,981 | A | * | 12/1957 | Nonnamaker et al. | 239/33 |
| 4,792,333 | A | * | 12/1988 | Kidder | 604/83 |
| 4,909,437 | A | * | 3/1990 | Kang | 239/33 |
| 4,981,468 | A | * | 1/1991 | Benefiel et al. | 604/83 |
| 5,335,851 | A | * | 8/1994 | Adaska et al. | 239/33 |
| 5,718,681 | A | * | 2/1998 | Manning | 239/33 |

* cited by examiner

*Primary Examiner* — Steven J Ganey
(74) *Attorney, Agent, or Firm* — Parson & Goltry; Michael W. Goltry; Robert A. Parsons

(57) ABSTRACT

Disclosed is a straw that consists of a fluid tube including a upstanding continuous sidewall having a proximal end forming an outlet, and an opposing distal end forming an inlet. The outlet and the inlet allow liquids to be drawn through the fluid tube from the distal end to the proximal end under suction pressure. A port extends through the continuous sidewall adjacent the proximal end thereof. The outlet defines a first size, the inlet defines a second size, and the port defines a third size. The second size is at least one of equal to and greater than the first size, and the third size is at least one of equal to and greater than the first size.

16 Claims, 5 Drawing Sheets

70
80
90
100
51
52
53
54
55
56
57
71

117
116
115
110
111
14
180
112
118
119
119A
143
130
144
141
142
164
145
151
164A
166
153
163
131
140
162
161
160
170
171
165
165B
133
155
154
164B
150
132
152
113
114

Fig. 18
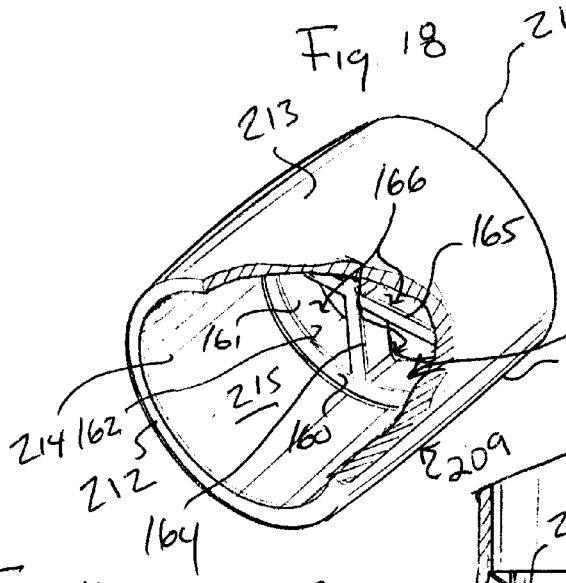
Fig. 16
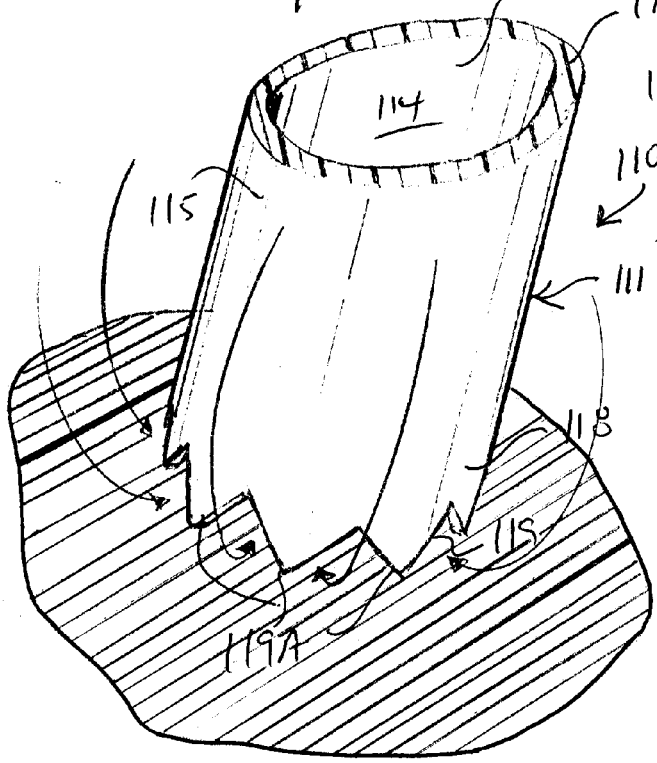
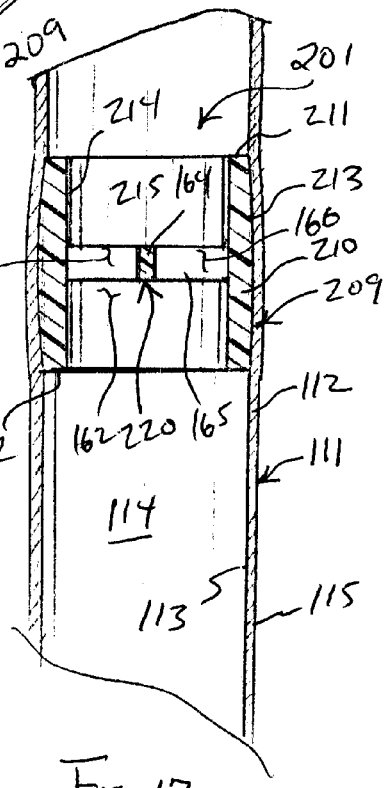
Fig. 17

BIKE
230
117
200
114
116
113
111
115
112
201

STRAW

CROSS REFERENCE TO RELATED APPLICATIONS

This application claims the benefit of U.S. Provisional Application Ser. No. 60/523,266, filed 19 Nov. 2003, and U.S. Provisional Application Ser. No. 60/529,123, filed 12 Dec. 2003.

BACKGROUND OF THE INVENTION

1. Field of the Invention

The present invention relates to straws, to straws with improved fluid transfer characteristics, and to straws for use in taking pills.

2. Related Art and Prior Art Statement

There are a wide variety of straws in the prior art that are useful for drinking beverages. Other straws incorporate features for providing individuals with a way to take vitamins and medicines in conjunction with a beverage, such as water or juice. Notwithstanding the many improvement made to straws by those having regard for the art, the state of the art of straws that are designed to increase the ease of taking in liquids by mouth and for providing improved ways of taking vitamins and medicines in various forms suffers in that current efforts have produced straws which are expensive, difficult to use, difficult to construct, and that often fail to accomplished the desired objectives. This is not entirely acceptable, which thus necessitates certain new and useful improvements in the art.

SUMMARY OF THE INVENTION

It is an object of the invention to provide straws which have enhanced flow characteristics, which provide individuals with a way to comfortably and efficiently take vitamins and medicines in pill form, which are simple in structure, which are low in cost, which are safe, which are easy to make, and which are easy to use.

According to the principle of the invention, there is provided a straw that consists of a fluid tube including a upstanding continuous sidewall having a proximal end forming an outlet, and an opposing distal end forming an inlet. The outlet and the inlet allow liquids to be drawn through the fluid tube from the distal end to the proximal end under suction pressure. A port is formed through the continuous sidewall adjacent the proximal end thereof. The outlet defines a first size, and the inlet defines a second size, and the port defines a third size. The second size is at least one of equal to and greater than the first size, and the third size is at least one of equal to and greater than the first size. In a particular embodiment, the inlet is notched. In another embodiment, the port has a shape in a form of a logo.

According to the invention, there is provided a straw that consists of a fluid tube including a upstanding continuous sidewall having an inner surface defining a fluid transfer path, an outer surface, a proximal end forming an outlet, and an opposing distal end forming an inlet. The outlet and the inlet allow liquids to be drawn through the fluid transfer path from the distal end to the proximal end under suction pressure. An insert is positioned in the fluid transfer path between the proximal and distal ends. The insert consists of a first annular fixture, a second annular fixture, and a pill-receiving shelf. The first annular fixture has a first upper end directed toward the outlet, an opposing first lower end directed toward the inlet, a first annular outer surface attached to the inner surface of the upstanding continuous sidewall, and a first annular inner surface defining first bore therethrough being concurrent with the fluid transfer path. The second annular fixture has a second upper end directed toward the outlet, an opposing second lower end directed toward the inlet, a second annular outer surface attached to the inner surface of the upstanding continuous sidewall, and a second annular inner surface defining a second bore therethrough being concurrent with the fluid transfer path and with the first bore. The pill-receiving shelf, which is in the fluid transfer path between the first bore and the second bore, is captured by and between the first lower end of the first annular fixture and the second upper end of the second annular fixture, and has ports formed therethrough which are sufficiently large enough to allow liquids to pass therethrough from the second bore of the second annular fixture to the first bore of the first annular fixture. The outlet and the inlet are substantially equal in size. Preferably, the inlet is notched. The pill-receiving shelf consists of an annular rim bounding an opening therethrough that is concurrent with the first and second bores and the fluid flow path. The annular rim is captured by and between the first lower end of the first annular fixture and the second upper end of the second annular fixture. A plurality of intersecting vanes are disposed at the opening and are attached to the annular rim. The plurality of ports of the pill-receiving shelf are defined by the intersecting vanes and the annular rim. The plurality of intersecting vanes includes a first vane having opposing ends affixed to the annular rim, and a second vane perpendicular to the first vane and having opposing ends affixed to the annular rim, in which the first vane is joined to the second vane.

According to the principle of the invention, there is provided a straw consisting of a fluid tube including a upstanding continuous sidewall having an inner surface defining a fluid transfer path, an outer surface, a proximal end forming an outlet, and an opposing distal end forming an inlet. The outlet and the inlet allow liquids to be drawn through the fluid transfer path from the distal end to the proximal end under suction pressure. An insert is positioned in the fluid transfer path between the proximal and distal ends, and consists of an annular fixture having an upper end directed toward the outlet, an opposing lower end directed toward the inlet, an annular outer surface attached to the inner surface of the upstanding continuous sidewall, and an annular inner surface defining a bore therethrough being concurrent with the fluid transfer path. The insert also includes a pill-receiving shelf in the bore, which is attached to the annular inner surface of the annular fixture between the upper and lower ends thereof. The pill-receiving shelf has ports formed therethrough, which are sufficiently large enough to allow liquids to pass therethrough. The outlet and the inlet are substantially equal in size. Preferably, the inlet is notched. The pill-receiving shelf includes an annular rim bounding an opening therethrough that is concurrent with the bore and the fluid flow path. The annular rim is attached to the annular inner surface of the fixture between the upper and lower ends thereof. The insert further includes a plurality of intersecting vanes disposed at the opening, and that are attached to the annular rim. The plurality of ports of the pill-receiving shelf is defined by the intersecting vanes and the annular rim. The plurality of intersecting vanes includes a first vane having opposing ends affixed to the annular rim, and a second vane perpendicular to the first vane and having opposing ends affixed to the annular rim. The first vane is joined to the second vane. Preferably, the insert of the instant embodiment is integrally formed.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings:

FIG. 16 is an enlarged fragmented perspective view of the inlet end of the straw of FIG. 13;

FIG. 17 is a vertical sectional view of yet a further alternate embodiment of a straw constructed and arranged in accordance with the principle of the invention, the straw incorporating an insert disposed therein;

FIG. 18 is an enlarged perspective view of the insert of FIG. 17, with portions thereof broken away for the purpose of illustration;

DETAILED DESCRIPTION OF PREFERRED EMBODIMENTS

Figure 1:
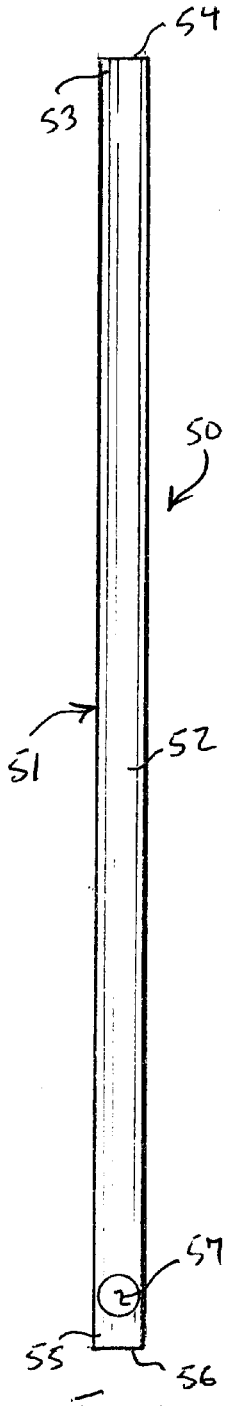
FIG. 1 is front elevational view of a straw constructed and arranged in accordance with the principle of the invention, the straw having an inlet end and an opposing outlet end.
Figure 2:
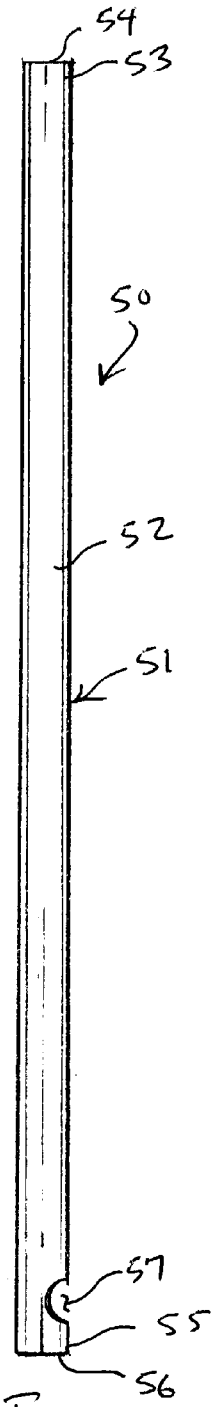
FIG. 2 is a side elevational view of the straw of FIG. 1.

Turning now to the drawings, in which like reference characters indicate corresponding elements throughout the several views, attention is first directed to FIG. 1 in which there is seen a front elevational view of a straw 50 constructed and arranged in accordance with the principle of the invention, including an elongate, fluid tube 51 which is shaped like an ordinary drinking straw and defines a fluid flow/transfer path therethrough. Fluid tube 51 is fashioned of plastic, and is approximately 8 inches long with a 0.25 inch interior diameter. Those having regard for the art will readily appreciate that the dimensions and materials used are not critical to the invention so long as an individual can comfortably drink from straw 50.

Figure 3:
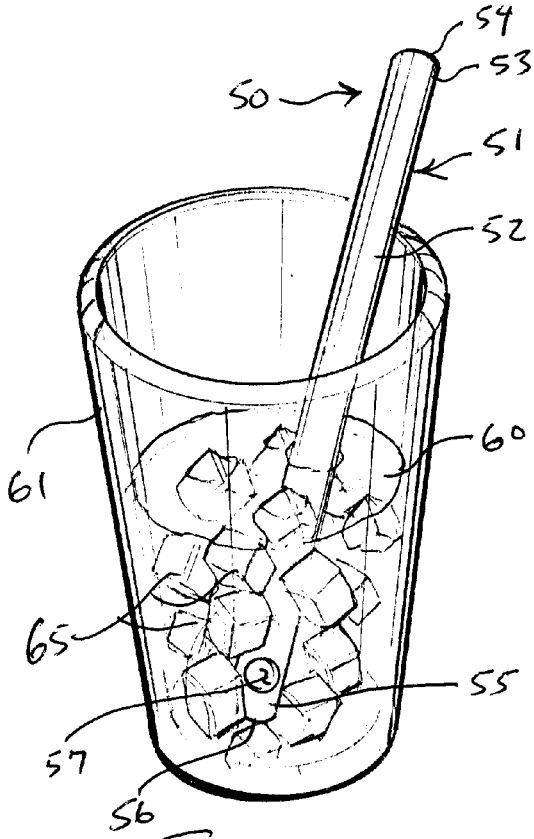
FIG. 3 is a perspective view of the straw of FIG. 1 shown as it would appear with its inlet end disposed in a liquid held by a container.
Figure 4:
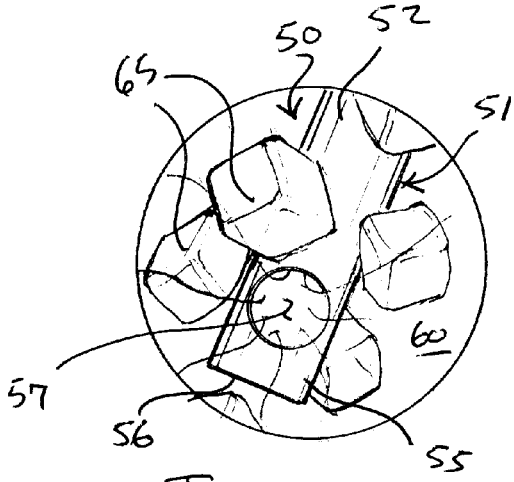
FIG. 4 is an enlarged fragmented perspective view of the inlet end of the straw of FIG. 1 shown as it would appear disposed in a liquid.

Fluid tube 51 consists of an upstanding continuous sidewall 52 having a proximal end 53 forming an outlet 54 having a size, and an opposing distal end 55 forming an inlet 56 having a size. Proximal end 53 is the outlet end of straw 50, and distal end 55 is the inlet end of straw 50. Proximal end 53 is the end of straw 50 from which an individual drinks, as such is the case with a conventional straw. Outlet 54 and inlet 56 allow liquids to be drawn through fluid tube 51 from distal end 55 to proximal end 53 under suction pressure applied at outlet 54. As a matter of illustration, FIG. 3 is a perspective view of straw 50 shown as it would appear with the inlet end of straw 50 (i.e., distal end 55 and its inlet 56) disposed in a liquid 60 held by a container 61, and the outlet end of straw 50 (i.e., proximal end 53 and its outlet 54) projecting upwardly from container 61 from which an individual may drink by placing his mouth over proximal end 53 and apply a sucking force drawing liquid 60 through straw 50 from inlet 56 to outlet 54. FIG. 4 is an enlarged fragmented perspective view of the inlet end of straw 50 disposed in liquid 60.

As seen in FIGS. 1-4, a port 57 extends through continuous sidewall 52, and is located adjacent, namely, just inboard of, proximal end 53. Straw 50 can be integrally molded or formed with port 57. Port 57 can also be stamped or cut from continuous sidewall 52. Port 57, which has a size, is considered part of the inlet end of straw 50 and provides an additional inlet through which liquid is drawn into straw 50 during use thereof for drinking. Ice, such as one or more of ice chips 65 in liquid 60 as denoted in FIGS. 3 and 4, food solids, or the bottom surface of container 61 holding liquid 69, can obstruct inlet 56 while straw 50 is in use. According to the invention, inlet 56 can be obstructed, whether partially or totally, while port 57 provides for normal flow of liquid through straw 50.

The internal diameter of straw 50 is constant from inlet 56 to outlet 54, and the size of inlet 56 is equal to the size of outlet 54. In the instant embodiment, the internal diameter of fluid tube 51 is 0.25 inches, and the size of inlet 56 and the size of outlet 56 are each also 0.25 inches. According to the invention, the size of port 57, namely, its internal diameter as defined by the parametric edge defining port 57, is equal to the size of inlet 56 and also to the size of outlet 54, namely, 0.25 inches. This is important, because in the event inlet 56 becomes obstructed, either partially or totally, port 57 functions exactly like inlet 56 providing normal flow of liquid through straw 50. Although the sizes of inlet 56, outlet 54, and port 57 are each 0.25 inches, the sizes of inlet 56, outlet 54, and port 57 can each be less than or greater than 0.25 inches, so long as the sizes of inlet 56, outlet 54, and port 57 are each equal to one another in a preferred embodiment of the invention. Nevertheless, it is to be understood that the size of inlet 56 and the size of port 57 are each at least one of equal to and greater than the size of outlet 54, according to the principle of the invention. In the instant embodiment of straw 50, port 57 is circular in shape, and other shapes can be used as will now be discussed in conjunction with FIGS. 5-7.

Figures 5, 6, 7, 8, 9, 10, 11, 12:
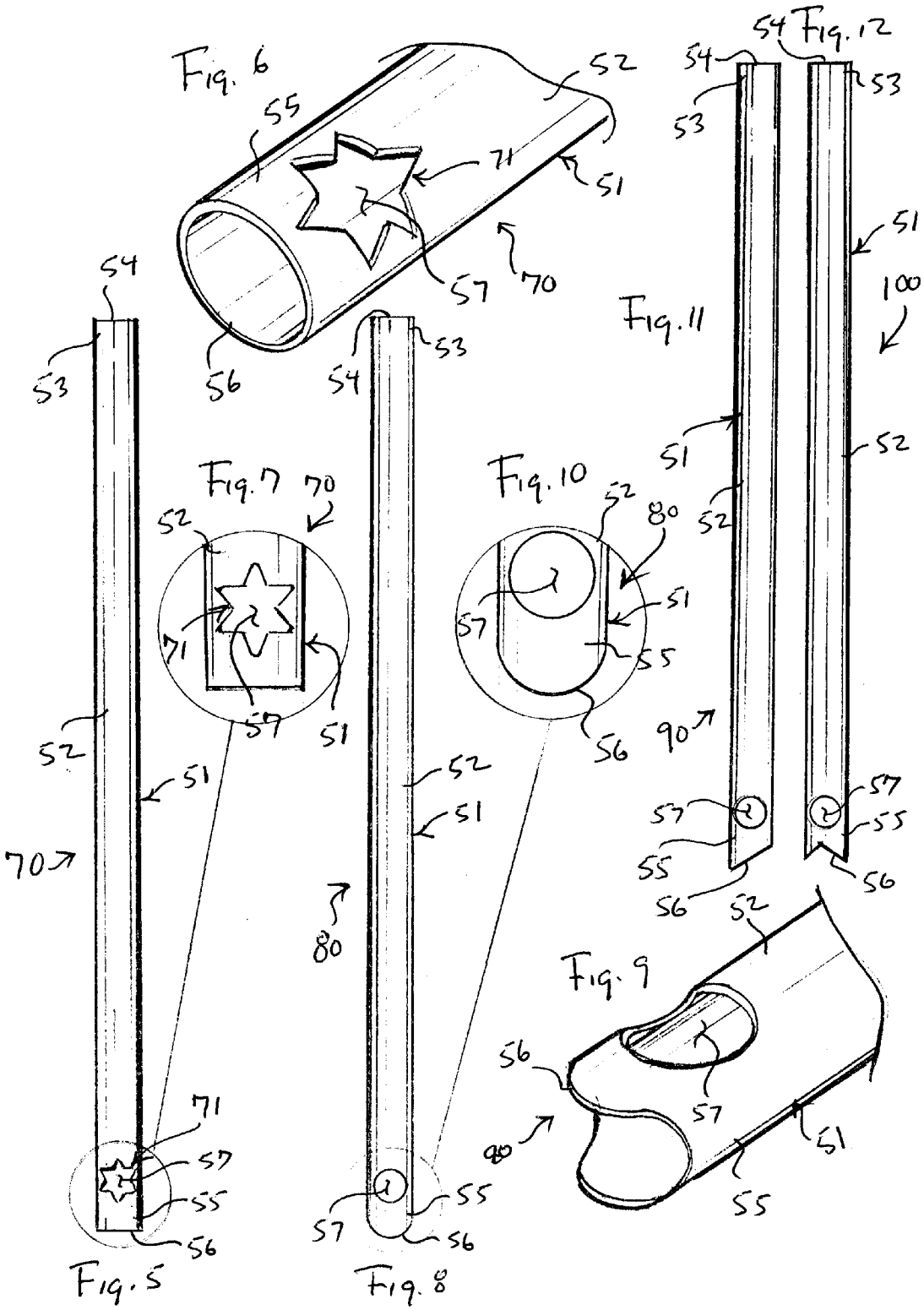
FIG. 5 is a front elevational view of an alternate embodiment of a straw constructed and arranged in accordance with the principle of the invention, the straw having an inlet end and an outlet end.
FIG. 6 is an enlarged fragmented perspective view of the inlet end of the straw of FIG. 5.
FIG. 7 is an enlarged fragmented front elevational view of the inlet end of the straw of FIG. 5.
FIG. 8 is a front elevational view of another alternate embodiment of a straw constructed and arranged in accordance with the principle of the invention, the straw having an inlet end and an outlet end.
FIG. 9 is an enlarged fragmented perspective view of the inlet end of the straw of FIG. 8.
FIG. 10 is an enlarged fragmented front elevational view of the inlet end of the straw of FIG. 8.
FIG. 11 is a front elevational view of yet another alternate embodiment of a straw constructed and arranged in accordance with the principle of the invention, the straw having an inlet end and an outlet end.
FIG. 12 is a front elevational view of yet still another alternate embodiment of a straw constructed and arranged in accordance with the principle of the invention, the straw having an inlet end and an outlet end.

Attention is now directed to FIG. 5 in which there is seen a front elevational view of another embodiment of a straw 70 constructed and arranged in accordance with the principle of the invention. In common with straw 50, straw 70 shares fluid tube 51, continuous sidewall 52, an outlet end including proximal end 53 and outlet 54, an inlet end including distal end 55 and inlet 56, and port 57. Unlike port 57 in conjunction with straw 50, port 57 in conjunction with straw 70 is in a form/shape of a symbol designated generally at 71, which symbolizes a logo, trademark, or other specific character. In the instant embodiment of port 57 in conjunction with straw 70, symbol 71 defined by port 57 is in a shape of a star. It will be understood that other symbols can be used symbolizing any desired logo, trademark, or character. According to the principle of the invention, providing port 57 in the form of a symbol symbolizing a logo or trademark provides an exemplary way of advertising a designated logo or trademark. As a matter of disclosure, FIG. 6 is an enlarged fragmented perspective view of the inlet end of straw 70 showing symbol 71 defined by port 57, and FIG. 7 is an enlarged fragmented front elevational view of the inlet end of straw 70 showing symbol 71 defined by port 57.

Attention is now directed to FIG. 8 in which there is seen a front elevational view of a yet another embodiment of a straw 80 constructed and arranged in accordance with the principle of the invention. In common with straw 50, straw 80 shares fluid tube 51, continuous sidewall 52, an outlet end including proximal end 53 and outlet 54, an inlet end including distal end 55 and inlet 56, and port 57. Port 57 has a shape like that provide with straw 50, but it can be in the form of a symbol symbolizing a logo, trademark, or other specific character, as taught herein in conjunction with straw 70. In the embodiment of straw designated at 80, inlet 56 is notched to prevent restriction of liquid flow therethrough. In conjunction with straw 80, distal end 55 is radiused as shown in FIG. 9, which defines the notched character of inlet 56, in which FIG. 9 is an enlarged fragmented perspective view of the inlet end of straw 80 showing its notched character. As a matter of disclosure, FIG. 10 is an enlarged fragmented front elevational view of the inlet end of straw 80 showing its notched character.

Attention is now directed to FIG. 11 in which there is seen a front elevational view of a yet still another embodiment of a straw 90 constructed and arranged in accordance with the principle of the invention. In common with straw 50, straw 90 shares fluid tube 51, continuous sidewall 52, an outlet end including proximal end 53 and outlet 54, an inlet end including distal end 55 and inlet 56, and port 57. Port 57 has a shape like that provide with straw 50, but it can be in the form of a symbol symbolizing a logo, trademark, or other specific character, as taught herein in conjunction with straw 70. In the embodiment of straw designated at 90, inlet 56, like that of straw 80, is notched to prevent restriction of liquid flow therethrough. In conjunction with straw 90, distal end 55 is cut at an angle, which defines the notched character of inlet 56 of straw 90.

Attention is now directed to FIG. 12 in which there is seen a front elevational view of a further embodiment of a straw 100 constructed and arranged in accordance with the principle of the invention. In common with straw 50, straw 100 shares fluid tube 51, continuous sidewall 52, an outlet end including proximal end 53 and outlet 54, an inlet end including distal end 55 and inlet 56, and port 57. Port 57 has a shape like that provide with straw 50, but it can be in the form of a symbol symbolizing a logo, trademark, or other specific character, as taught herein in conjunction with straw 70. In the embodiment of straw designated at 100, inlet 56, like that of straws 80 and 90, is notched to prevent restriction of liquid flow therethrough. In conjunction with straw 100, distal end 55 has a V-shape cut formed therein, which defines the notched character of inlet 56 of straw 100. According to the discussion of the straws 80, 90, and 100, it will be understood that an inlet end of a straw constructed and arranged in accordance with the principle of the invention can other notched shapes sufficient to prevent restriction of liquid flow therethrough.

Figures 13, 14, 15:
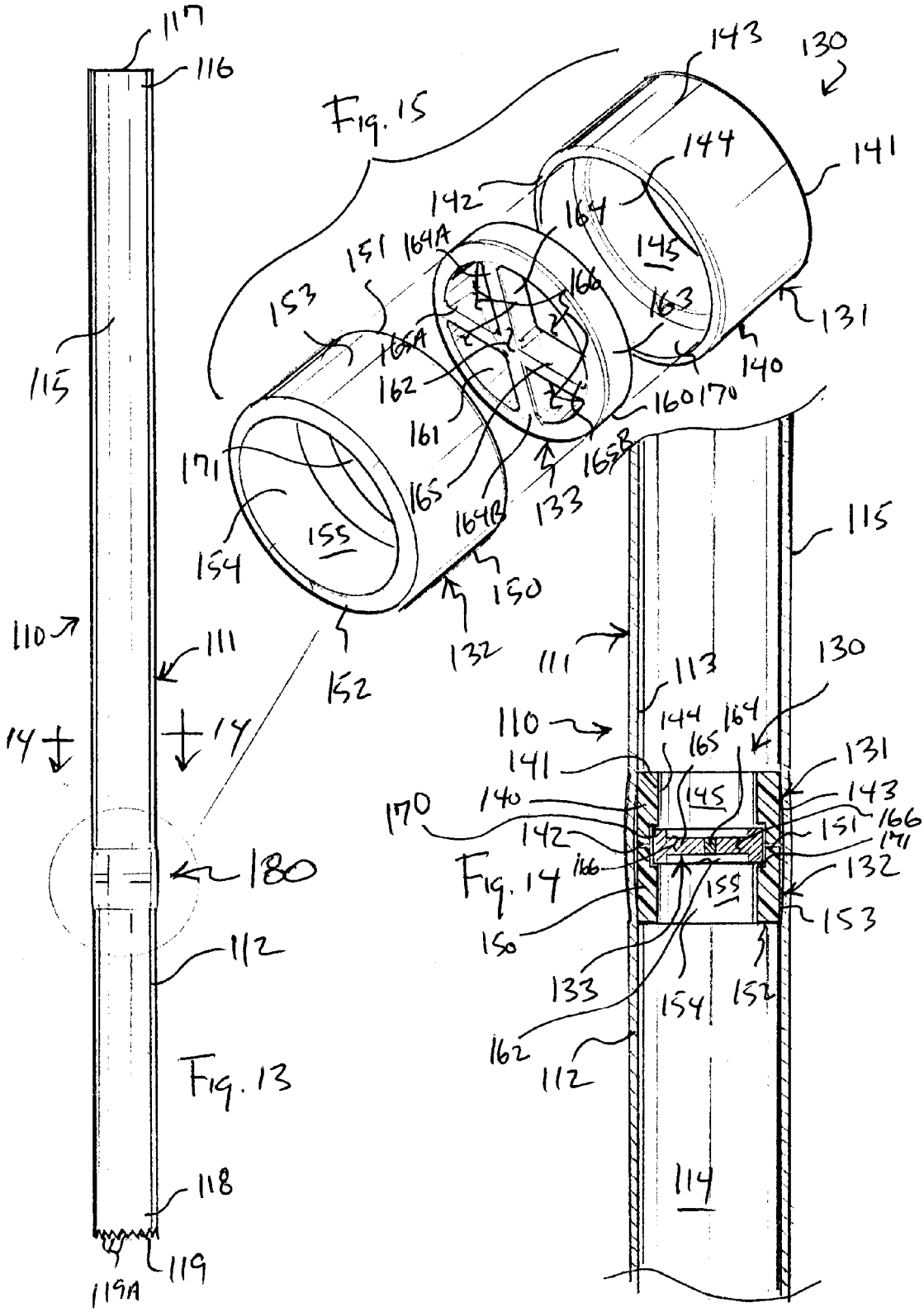
FIG. 13 is a front elevational view of a further alternate embodiment of a straw constructed and arranged in accordance with the principle of the invention.
FIG. 14 is a fragmented sectional view taken along line 14-14 of FIG. 13 illustrating an insert positioned in the straw.
FIG. 15 is an enlarged exploded perspective view of the insert of FIG. 14.

Reference is now made to FIG. 13, in which there is seen yet a further embodiment of a straw 110 constructed and arranged in accordance with the principle of the invention, including an elongate, fluid tube 111 which is shaped like an ordinary drinking straw including a upstanding continuous sidewall 112 having an inner surface 113 (FIG. 14) defining a fluid flow/transfer path 114 (FIG. 14) therethrough, an outer surface 115, a proximal end 116 forming an outlet 117 having a size, and an opposing distal end 118 forming an inlet 119 having a size. Fluid tube 111 is fashioned of plastic, and is approximately 8 inches long with a 0.35 inch interior diameter as defined by inner surface 113. Those having regard for the art will readily appreciate that the dimensions and materials used are not critical to the invention so long as an individual can comfortably drink from straw 110.

Proximal end 116 is the outlet end of straw 110, and distal end 118 is the inlet end of straw 110. Proximal end 116 is the end of straw 110 from which an individual drinks. Outlet 117 and inlet 119, which are preferably substantially equal in size, allow liquids to be drawn through fluid flow path 114 of fluid tube 111 from distal end 118 to proximal end 116 under suction pressure applied at outlet 117. Inlet 119, like that of straws 80, 90, and 100, is notched to prevent restriction of liquid flow therethrough. Distal end 118 can be provided with port 57 as discussed in conjunction with straws 50, 70, 80, 90, and 100, if desired. In conjunction with straw 110, distal end 118 is cut or formed with serrations 119A, which defines the notched character of inlet 119. FIG. 16 is an enlarged FIG. 10 is an enlarged fragmented perspective view of the inlet end of straw 110 showing its notched character as provided by serrations 119A. It will be understood that distal end 118 can be notched like that of any of straws 80, 90, and 100.

Referring to FIG. 14, an insert 130 is positioned in fluid flow path 114 between proximal and distal ends 116 and 118, respectively (not shown in FIG. 14. With continuing reference to FIG. 14 and additional reference to FIG. 15, insert 130 consists of annular fixtures 131 and 132, and a pill-receiving shelf 133. Preferably, fixtures 131 and 132 and shelf 133 are each fashioned of plastic or other similar material or combination of materials, and are each either integrally-formed, such as through molding or machining, or fashioned as an assembly of two or more parts attached by way of welding, with a suitable adhesive, etc.

Fixture 131 consists of an annular body 140 having an upper end 141, an opposing lower end 142, an annular outer surface 143, and an annular inner surface 144 defining a bore 145 therethrough extending from lower end 142 to upper end 141. Fixture 132 is a substantial mirror image of fixture 131, including an annular body 150 having an upper end 151, an opposing lower end 152, an annular outer surface 153, and an annular inner surface 154 defining a bore 155 therethrough extending from lower end 152 to upper end 151.

Pill-receiving shelf 133 consists of an annular or parametric rim 160 having an annular inner surface 161 bounding an opening 162 therethrough, an annular outer surface 163, and vanes 164 and 165 disposed at opening 162. Vane 164 has opposing ends 164A and 164B affixed to inner surface 161, and vane 165 has opposing ends 165A and 165B affixed to inner surface 161. Vanes 164 and 165 are disposed perpendicular relative to each other, and intersect each other at a midpoint thereof, respectively, where they are joined. Vanes 164 and 165 and inner surface 161 of annular rim 160 define four, equally-sized ports 166 and this is preferred for simplicity of construction. Ports 166 can be of differently sized, or of varying sizes, if desired, and can take on any desired shape, such as wedge-shaped as with shelf 133, round, oval, etc. Vanes 164 and 165 can be provided in different shapes and dimensions. Also, although shelf 133 incorporates two vanes, namely, vanes 164 and 165, more can be employed, and in varying shapes and configurations and dimensions, for providing more than four ports, or any desired number of ports.

Looking to FIG. 14, insert 130 is positioned in straw 110 in fluid transfer path 114. Fixture 131 is directed toward outlet 117, fixture 132 is directed toward inlet 119, and shelf 133 is captured by and between fixtures 131 and 132. As seen in FIG. 14, upper end 141 of fixture 131 is directed upwardly toward outlet 117 (not shown in FIG. 14), lower end 142 of fixture 131 is directed downwardly toward inlet 119 (not shown in FIG. 14), annular outer surface 143 of fixture 131 is attached to inner surface 113 of continuous sidewall 112, and bore 145 is concurrent with fluid flow path 114. Upper end 151 of fixture 132 is directed upwardly toward outlet 117 and faces and confronts lower end 142 of fixture 131, lower end 152 of fixture 132 is directed downwardly toward inlet 119, annular outer surface 153 is attached to inner surface 113 of continuous sidewall 112, and bore 155 is concurrent with fluid flow path 114 and with bore 145 of fixture 131. Preferably, the outer diameters of fixtures 131 and 132 as defined by outer surfaces 143 and 153 thereof, respectively, are each somewhat larger than the inner diameter of straw 110 as defined by inner surface 113, in which outer surfaces 143 and 153 of fixtures 131 and 132 frictionally impinge against inner surface 113 retaining fixtures 131 and 132 in place. This manner of attaching fixtures 131 and 132 to inner surface 113 of straw is preferred because it is simple, inexpensive, and efficient. It will be understood that fixtures 131 and 132 can be secured to inner surface 113 in other ways, such as with a suitable adhesive, without departing from the principles of the invention. Also, fixtures 131 and 132 and shelf 133 are retained together without additional help, such as with a suitable adhesive. However, a suitable adhesive may be used for securing together fixtures 131 and 132 and shelf 133.

Pill-receiving shelf 133 is in the fluid flow path 114 between bores 145 and 155, and is captured by and between lower end 142 of fixture 131 and upper end 151 of fixture 132. In particular, annular rim 160 is seated into an annular seat 170 formed into inner surface 144 of fixture 131, and into an opposing annular seat 171 formed into inner surface 154 of fixture 132. Opening 162 defined by annular rim 160 is concurrent with fluid flow path 114 and bores 145 and 155, and ports 166 at opening 162 are sufficiently large enough to allow liquids to pass therethrough from bore 155 of fixture 132 to bore 145 of fixture 131, and yet small enough to prevent a standard-sized pill from passing therethrough. Although seats 170 and 171 are inwardly directed and formed into inner surfaces 144 and 154 of fixtures 131 and 132, respectively, in which annular rim 160 is sized to fit appropriately therein, seats 170 and 171 can be formed annular channels formed axially into lower and upper ends 142 and 151 of fixtures 131 and 132, respectively, or can be formed into outer surfaces 143 and 153 of fixtures 131 and 132, respectively, so as to form outwardly-directed annular seats, and that in whichever case it will be understood that annular rim 160 of seat 133 is to be appropriately sized to be retained therein.

Straw 110 is useful for providing individuals with a way to take pills by mouth, such as medicinal pills, vitamin pills, sleeping pills, etc. To use straw 110 to take a pill, straw 110 is taken up, such as by hand, and held upright with proximal end 116 directed upwardly. A pill is taken up, such as be hand, and placed into outlet 117. The internal diameter of straw 110 as defined by inner surface 113 is sufficiently large to permit the pill, which is a standard-sized pill, to pass through fluid flow path 114 and come to rest upon shelf 133 and, more particular, vanes 164 and 165, in which ports 166 are sufficiently small to prevent the pill from passing therethrough. Depending on the size of the pill, it is to be understood that ports 166 are to be provided so that they are sufficiently small to prevent a pill to be injected from passing therethrough, whatever that pill and its size may be. With the pill resting on the upper surfaces of vanes 164 and 165, the pill is held there and positioned at bore 145. At this point, distal end 118 of straw 110 is positioned into a palatable liquid, such as water or juice or the like. The individual to take the pill places proximal end 116 into his mouth and applies a sucking force which draws the liquid into fluid flow path 114 through inlet 119, in which the notched character thereof prevents restriction of liquid flow therethrough.

As the liquid passes into and through fluid flow path 114, it will encounter insert 130, in which it will enter bore 155 and pass therefrom and through ports 166, which, as previously discussed, are sufficiently large to allow liquids to pass therethrough. The liquid passes through ports 166 and into bore 145 encountering pill positioned therein and resting on vanes 164 and 165. The flowing liquid takes up the pill, which is taken upstream with the flow of the liquid, in which the pill and the liquid pass outwardly from outlet 117 and into the individual's mouth to be swallowed concurrently with the drinking of the liquid, in accordance with the principle of the invention. When an individual sucks and drinks liquid with a straw, the sucking action of the individual causes the back of the throat to naturally open and becomes relaxed in anticipation of drinking the liquid drawn through the straw. Accordingly, when a user employs straw 110 to take a pill, the pill is swallowed concurrently with the liquid as the user sucks the liquid up with the straw with very little feeling encountered by the pill passing into the individual's mouth and down the individual's throat concurrently with the liquid.

According to a preferred embodiment of the invention, and with reference to FIG. 13, insert 130 is located at a point 180 of straw which is closer to inlet 119 than to outlet 117, so as to position shelf 133 (not shown in FIG. 13, closer to inlet 119 than to outlet 117. Although this arrangement is preferred because it provides better flow characteristics of liquid through fluid flow path 114 (not shown in FIG. 13) for taking a pill, insert 130 can be positioned at other locations along the length of straw 110 between the inlet and outlet ends of straw 110 for positioning shelf 133 at any desired location.

Insert 130 is made of three separate parts, namely, fixture 131, fixture 132, and shelf 133. An insert constructed and arranged in accordance with the principle of the invention can be made as a single or integral unit, if desired. Considering the latter aspect, attention is now directed to FIG. 17, in which there is seen an alternate embodiment of a straw 200 having an insert 201 disposed therein, in accordance with the principle of the invention. With the exception of certain aspects of insert 201, straw 200 is substantially identical to straw 110, and it is to be understood that the foregoing discussion of straw 110 applies to straw 200. For the purposes of orientation and reference, straw 200 is common to straw 110 in that it shares fluid tube 111, continuous sidewall 112, inner surface 113, fluid flow/transfer path 114, outer surface 115, the outlet end (not shown), and the inlet end (not shown).

Looking now to FIG. 18, insert 201 is constructed of the same material or combination of materials as insert 130 and rather than formed as a plurality of separable parts as with insert 130 is integrally formed, such as through molding or machining, as a single unit including an annular fixture 209 and pill-receiving shelf 220. Annular fixture 209 includes an annular body 210 having an upper end 211, an opposing lower end 212, an annular outer surface 213, and an annular inner surface 214 defining a bore 215 therethrough. Insert 201 incorporates a pill receiving shelf 220, which is common to pill-receiving shelf 133 in that it shares annular rim 160, inner surface 161, opening 162, vanes 164 and 165, and ports 166. In structure and function, shelf 220 is identical to shelf 103, and the foregoing discussion of shelf 133 applies to shelf 220.

Shelf 220 is positioned in bore 205, and opening 162 is concurrent therewith. Unlike insert 133, shelf 220 is integrally formed with inner surface 214, and is disposed between upper and lower ends 211 and 212.

Figures 19, 20, 21:
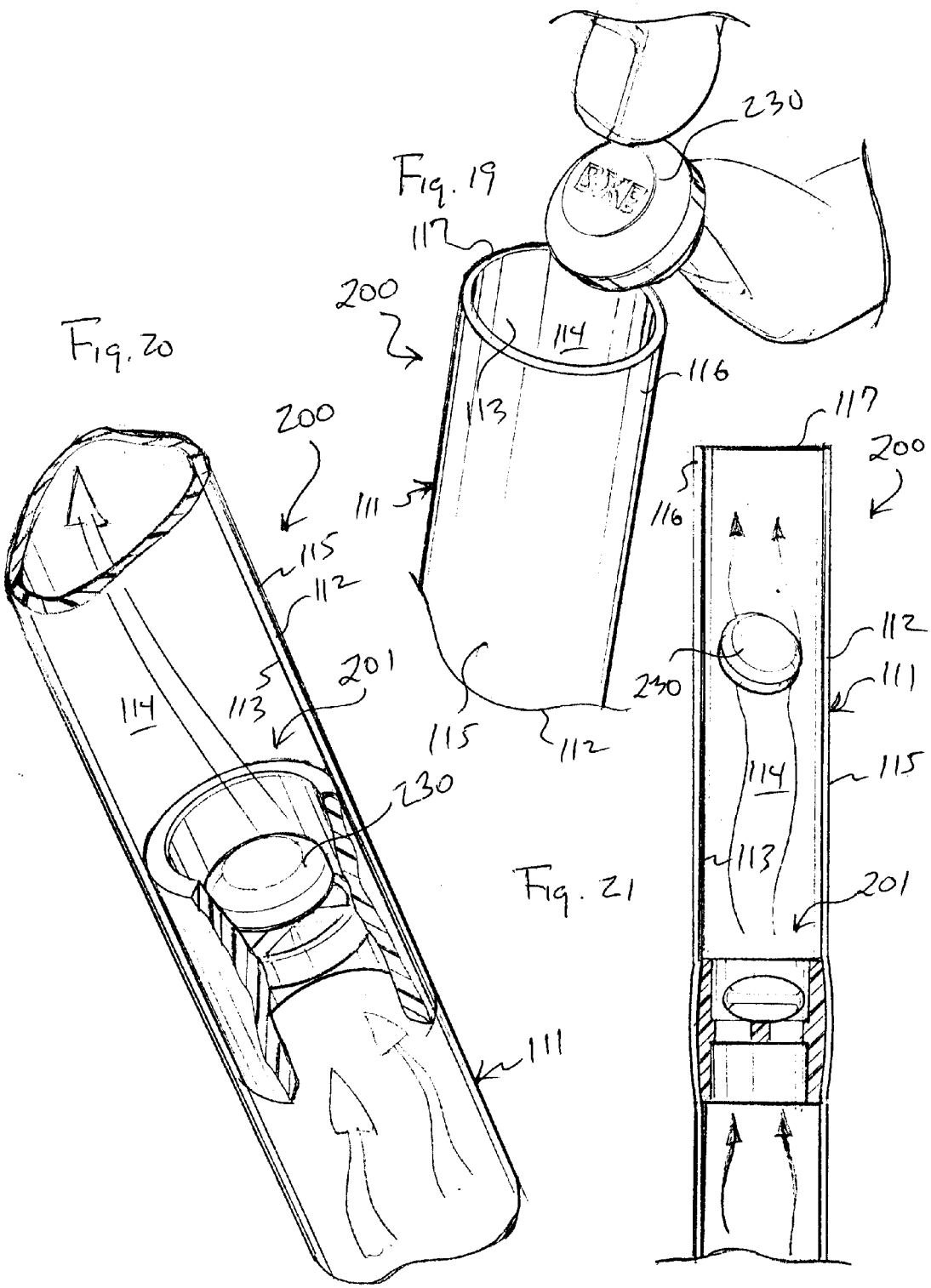
FIG. 19 is an enlarged fragmented perspective view of the straw of FIG. 17 showing a pill in the process of being inserted into the outlet end.
FIG. 20 is a fragmented perspective view of the straw of FIG. 17 with the pill of FIG. 19 shown as it would appear positioned on the insert.
FIG. 21 is a view very similar to the view of FIG. 17 with the pill of FIG. 19 shown as it would appear positioned on the insert.

Referring to FIGS. 17 and 21, insert 201 is positioned in straw 200 in fluid flow path 114 between proximal and distal ends 116 and 118 (not shown in FIG. 17). Upper end 211 of fixture 209 is directed upwardly toward outlet 117 (FIG. 21) and lower end 212 of fixture 209 is directed downwardly toward outlet 119 (not shown), and annular outer surface 213 of fixture 209 is attached to inner surface 113 of continuous sidewall 112 in the same manner as each of fixtures 131 and 132 of insert 130, and so the discussion of the attachment of the annular outer surfaces of fixtures 131 and 132 to inner surface 113 also applies to the attachment of annular outer surface 213 to inner surface 113 of continuous sidewall 112. Bore 215 is concurrent with fluid flow path 114. Pill-receiving shelf 220 is in bore 215 and is in the fluid flow path 114 between upper and lower ends 211 and 212 of fixture 209.

Like straw 110, straw 200 is useful for providing individuals with a way to take pills by mouth, such as medicinal pills, vitamin pills, sleeping pills, etc. To use straw 200 to take a pill, straw 200 is taken up, such as by hand, and held upright with proximal end 116 directed upwardly as shown in FIG. 19. A pill 230 is taken up, such as be hand, and placed into outlet 117. The internal diameter of straw 200 as defined by inner surface 113 is, like straw 110, sufficiently large to permit pill 230, which is a standard-sized pill, to pass through fluid flow path 114 and come to rest upon shelf 220 and, more particular, vanes 164 and 165, in which ports 166 are sufficiently small to prevent the pill from passing therethrough. With pill 230 resting on the upper surfaces of vanes 164 and 165 as shown in FIGS. 20 and 21, pill 230 is held there and positioned in or otherwise at bore 215. At this point, the inlet end (not shown) of straw 200 is positioned into a palatable liquid, such as water or juice or the like. The individual to take the pill places proximal end 116 (FIGS. 19 and 21) into his mouth and applies a sucking force which draws the liquid into fluid flow path 114 through the inlet end.

As the liquid passes into and through fluid flow path 114, it will encounter insert 201, in which it will enter bore 215 and pass through ports 166 therein, which, as previously discussed in conjunction with insert 130, are sufficiently large to allow liquids to pass therethrough. The liquid passes through ports 166 and encounters pill 230 positioned therein bore 215 and resting on vanes 164 and 165. The flowing liquid takes up pill 230, which is taken upstream with the flow of the liquid, in which pill 230 and the liquid pass outwardly from outlet 117 and into the individual's mouth to be swallowed concurrently with the drinking of the liquid as previously discussion in conjunction with straw 110, in accordance with the principle of the invention. Like straw 110, insert 201 is preferably located at a point of straw 200 which is closer to the inlet end of straw 200 than to the outlet end of straw 200 for positioning shelf 220 closer to the inlet end of straw 200 than to the outlet end of straw 200, although it can be positioned at other locations along the length of straw 200 between its inlet and outlet ends for positioning shelf 220 at any desired location.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A straw, comprising:

a fluid tube including a upstanding continuous sidewall having an inner surface defining a fluid transfer path, an outer surface, a proximal end forming an outlet, and an opposing distal end forming an inlet;

the outlet and the inlet allowing liquids to be drawn through the fluid transfer path from the distal end to the proximal end under suction pressure;

an insert positioned in the fluid transfer path between the proximal and distal ends, comprising:

a first annular fixture having a first upper end directed toward the outlet, an opposing first lower end directed toward the inlet, a first annular outer surface attached to the inner surface of the upstanding continuous sidewall, a first annular inner surface defining a first bore therethrough being concurrent with the fluid transfer path;

a second annular fixture having a second upper end directed toward the outlet, an opposing second lower end directed toward the inlet, a second annular outer surface attached to the inner surface of the upstanding continuous sidewall, a second annular inner surface defining a second bore therethrough being concurrent with the fluid transfer path and with the first bore;

a pill-receiving shelf in the fluid transfer path between the first bore and the second bore, the pill-receiving shelf captured by and between the first lower end of the first annular fixture and the second upper end of the second annular fixture and having ports formed therethrough which are sufficiently large enough to allow liquids to pass therethrough from the second bore of the second annular fixture to the first bore of the first annular fixture.

2. The straw according to claim 1, wherein the outlet and the inlet are substantially equal in size.

3. The straw according to claim 1, wherein the inlet is notched.

4. The straw according to claim 1, wherein the pill-receiving shelf comprises:

an annular rim bounding an opening therethrough that is concurrent with the first and second bores and the fluid flow path;

the annular rim captured by and between the first lower end of the first annular fixture and the second upper end of the second annular fixture;

a plurality of intersecting vanes disposed at the opening and attached to the annular rim; and the plurality of ports of the pill-receiving shelf defined by the intersecting vanes and the annular rim.

5. The straw according to claim 4, wherein the plurality of ports further comprise four equally-sized ports.

6. The straw according to claim 4, wherein the plurality of intersecting vanes includes:

a first vane having opposing ends affixed to the annular rim; and a second vane perpendicular to the first vane and having opposing ends affixed to the annular rim.

7. The straw according to claim 6, wherein the first vane is joined to the second vane.

8. The straw according to claim 1, wherein pill-receiving shelf is positioned closer to the inlet than the outlet.

9. A straw, comprising:

a fluid tube including a upstanding continuous sidewall having an inner surface defining a fluid transfer path, an outer surface, a proximal end forming an outlet, and an opposing distal end forming an inlet;

the outlet and the inlet allowing liquids to be drawn through the fluid transfer path from the distal end to the proximal end under suction pressure;

an insert positioned in the fluid transfer path between the proximal and distal ends, comprising:

an annular fixture having an upper end directed toward the outlet, an opposing lower end directed toward the inlet, an annular outer surface attached to the inner surface of the upstanding continuous sidewall, an annular inner surface defining a bore therethrough being concurrent with the fluid transfer path; and a pill-receiving shelf in the bore attached to the annular inner surface of the annular fixture between the upper and lower ends thereof, the pill-receiving shelf having ports formed therethrough which are sufficiently large enough to allow liquids to pass therethrough, and the pill-receiving shelf comprises:

an annular rim bounding an opening therethrough that is concurrent with the bore and the fluid flow path;

the annular rim attached to the annular inner surface of the fixture between the upper and lower ends thereof;

a plurality of intersecting vanes disposed at the opening and attached to the annular rim; and the plurality of ports of the pill-receiving shelf defined by the intersecting vanes and the annular rim.

10. The straw according to claim 9, wherein the outlet and the inlet are substantially equal in size.

11. The straw according to claim 9, wherein the inlet is notched.

12. The straw according to claim 9, wherein the plurality of ports further comprise four equally-sized ports.

13. The straw according to claim 9, wherein the plurality of intersecting vanes includes:

a first vane having opposing ends affixed to the annular rim; and a second vane perpendicular to the first vane and having opposing ends affixed to the annular rim.

14. The straw according to claim 13, wherein the first vane is joined to the second vane.

15. The straw according to claim 9, wherein pill-receiving shelf is positioned closer to the inlet than the outlet.

16. The straw according to claim 9, wherein the fixture and the vanes are integrally-formed.

* * * * *